US005777657A

United States Patent [19]

Negishi et al.

[11] Patent Number: 5,777,657

[45] Date of Patent: Jul. 7, 1998

[54] THERMAL PRINTER AND THERMAL PRINTER HEAD DRIVING SYSTEM

[75] Inventors: Kiyoshi Negishi; Mikio Horie; Katsumi Kawamura; Minoru Suzuki; Hiroshi Orita; Katsuyoshi Suzuki, all of Tokyo, Japan

[73] Assignee: Asahi Kogaku Kogyo Kabushiki Kaisha, Tokyo, Japan

[21] Appl. No.: 543,576

[22] Filed: Oct. 16, 1995

[30] Foreign Application Priority Data

Oct. 14, 1994 [JP] Japan ..... 6-276123

[51] Int. Cl.[6] ..... B41J 2/355

[52] U.S. Cl. ..... 347/211

[58] Field of Search ..... 347/171, 193, 347/194, 211, 218

[56] References Cited

U.S. PATENT DOCUMENTS 5,003,323 3/1991 Onuki et al. ..... 346/76 PH
5,208,608 5/1993 Okuyama et al. .
5,210,578 5/1993 Saito et al. .
5,220,350 6/1993 Fujii ..... 346/76 PH
5,559,547 9/1996 Hager ..... 347/211
5,629,731 5/1997 Kwon ..... 347/211

*Primary Examiner*—Adolf Berhane
*Attorney, Agent, or Firm*—Greenblum & Bernstein P.L.C.

[57] ABSTRACT

A thermal printer that forms an image on a sheet. The thermal printer includes a thermal head having a plurality of linearly arranged thermal elements, a device for converting image information into bit-map image data, and a device for storing the bit-map image data. A predetermined portion of the stored bit-map image data is transmitted to the thermal head, and a remaining amount of the stored bit-map image data which has not been transmitted to the thermal head is detected. A time interval between a transmission of the predetermined portion of the stored bit-map image data and a subsequent transmission of the predetermined portion of the stored bit-map image data is set, in response to the detected remaining amount of the stored bit-map image data.

16 Claims, 11 Drawing Sheets

I / F
27
PDATA1~8
DATASTB
BUSY
ACK
107
108 LED
109
GND
G / A
26
AB
DB
X'tal
15
GND
XTAL
EXTAL
AB23~0
AN1
DB15~0
CPU
Port1
Port2
Port3
Port4
Port5
Port6
RESET
PTOP
Port7
Port PON2
AN2 8 PON1
10
RESET IC
24
25
EPROM
21
DRAM
22
ROM
23
40
THERMAL HEAD
41
CLK
DATA1
DATA2
STB1
STB2
STB3
STB4
CHARGE
REFRESH
GND
CHARGE CONTROL CCT.
60
70
CC
CV
GND
80
81
82
51
52
53
VCC
GND
32
M
MOTOR DRIVE CCT.
31
ADPT.IN
SW
POWER SW
106
90
Batt.
GND
V−Batt
VCC
DC/DC CONVERTER
50

THERMAL PRINTER AND THERMAL PRINTER HEAD DRIVING SYSTEM

BACKGROUND OF THE INVENTION

The present invention relates to a thermal printer which performs an imaging operation by energizing linearly arranged thermal elements of a printing head.

Conventionally, thermal printers have a printing head with linearly arranged thermal elements which are energized in order to form an image on a thermosensitive paper. In this type of printer, the image data is converted into bit-map image data, and stored in a memory. The stored bit-map image data is transferred to an output buffer, and then each line of data is sent to a register of the thermal head. A line image corresponding to the line of data is then formed on the thermosensitive paper by the thermal head. In general, a predetermined amount of data is converted into bit-map image data at a time, and then immediately transferred to the output buffer.

In this type of thermal printer, as the printing operation proceeds, the amount of data to be converted to bit-map image data becomes large. Under this condition, the bit-map image data stored in the output buffer may be transferred at a higher rate to the register of the thermal head, than the rate at which the CPU is able to convert the data to the bit-map image data. In this case, there is a short period of tine in which there is no image being formed by the thermal head, even though there is more data to be printed. This results in a reduction of the temperature of the thermal head, which will produce an uneven darkness of the image that is formed on the thermosensitive paper.

Further, during the short period of time when there is no image being formed by the thermal head, the feeding of the sheet is stopped. When the printing operation is resumed, the feeding of the sheet is started. However, due to mechanical inertia of the sheet feeding motor and friction in feeding the paper, the position of the sheet may have been slightly shifted. Thus, the image formed on the sheet will not be positioned properly, thereby further degrading the quality of the printed image.

SUMMARY OF THE INVENTION

It is therefore an object of the present invention to provide an improved thermal printer which can prevent an uneven image from being formed on the thermosensitive paper.

According to an aspect of the present invention, there is provided a thermal printer for forming an image on a sheet. The thermal printer includes a thermal line head having a plurality of linearly arranged thermal elements, a device for converting image information into a bit-map image data and a device for storing the bit-map image data. A predetermined portion of the stored bit-map image data is transmitted to the thermal head, and a remaining amount of the stored bit-map image data which has not been transmitted to the thermal head is detected. A time interval between a transmission of the predetermined portion of the stored bit-map image data and a subsequent transmission of the predetermined portion of the stored bit-map image data, is set in response to the detected remaining amount of the stored bit-map image data.

In this embodiment, when the amount of remaining data is low, the time interval between successive transmissions is increased. Thus, there will always be image data stored in the storing device that is to be transferred to the plurality of thermal elements. This prevents a reduction in the temperature of the thermal head during the printing operation, and therefore the printing of the image will not be uneven.

Optionally, the thermal printer includes a device for feeding the sheet, and a device for energizing the plurality of thermal elements in accordance with the predetermined portion of the bit-map image data. The bit-map image data is transmitted synchronously with a feeding of the sheet, with a feeding speed of the sheet being controlled in response to the time interval set by the setting device.

Further optionally, the converting device includes a memory for storing the bit-map image data. The thermal printer includes another transmitting device for transmitting the bit-map image data stored in the memory, to the storing device. Furthermore, the setting device sets the time interval such that a transmission speed of the transmitting device does not exceed a transmission speed of the another transmitting device.

In a preferred embodiment, a thermosensitive sheet is used.

According to another aspect of the present invention, there is provided a method of driving a thermal line printer for forming an image on a sheet using a thermal line head having a plurality of linearly arranged thermal elements, the method including the steps of converting image information into a bit-map image data; storing the bit-map image data; transmitting a predetermined portion of the stored bit-map image data which has not been transmitted to the plurality of thermal elements; and setting a time interval between a transmission of the predetermined amount of the stored bit-map image data and a subsequent transmission of the predetermined amount of stored bit-map image data, in accordance with the detected remaining amount of the stored bit-map image data.

According to a third aspect of the present invention, there is provided a thermal printer for forming an image on a page of a sheet. The thermal printer includes a thermal head having a plurality of linearly arranged thermal elements, a bit-map memory for storing bit-map image data that is to be printed by the thermal printer, and a buffer memory for receiving the bit-map image data from the bit-map memory, the bit-map image data being transmitted from the buffer memory to the thermal head. The thermal printer transmits the bit-map image data from the bit-map memory to the buffer memory, and then transmits the bit-map image data from the buffer memory, line by line to the thermal head, line by line. A transmission of the bit-map image data from the buffer memory to the thermal head is controlled such that the buffer memory always stores data to be printed while the image is being printed on the page of the sheet.

Therefore, the printing of the image is not stopped while there is more image data still to be printed.

According to a fourth aspect of the present invention, there is provided a thermal printer for forming an image on a sheet. The thermal printer includes a thermal head having a plurality of linearly arranged thermal elements, and a device for converting image information into bit-map image data. The thermal printer further includes a first memory for storing the bit-map image data, and a second memory for storing a predetermined portion of the bit-map image. The predetermined portion of the bit-map image data is transmitted from the first memory to the second memory. A remaining amount of the bit-map image data stored in the first memory which has not been transmitted to the second memory is detected. A time interval between a transmission of the predetermined portion of the bit-map image data and a subsequent transmission of the predetermined portion of the bit-map image data, is set in response to the detected remaining amount of the bit-map image data stored in the first memory.

DESCRIPTION OF THE EMBODIMENTS

Figure 1:
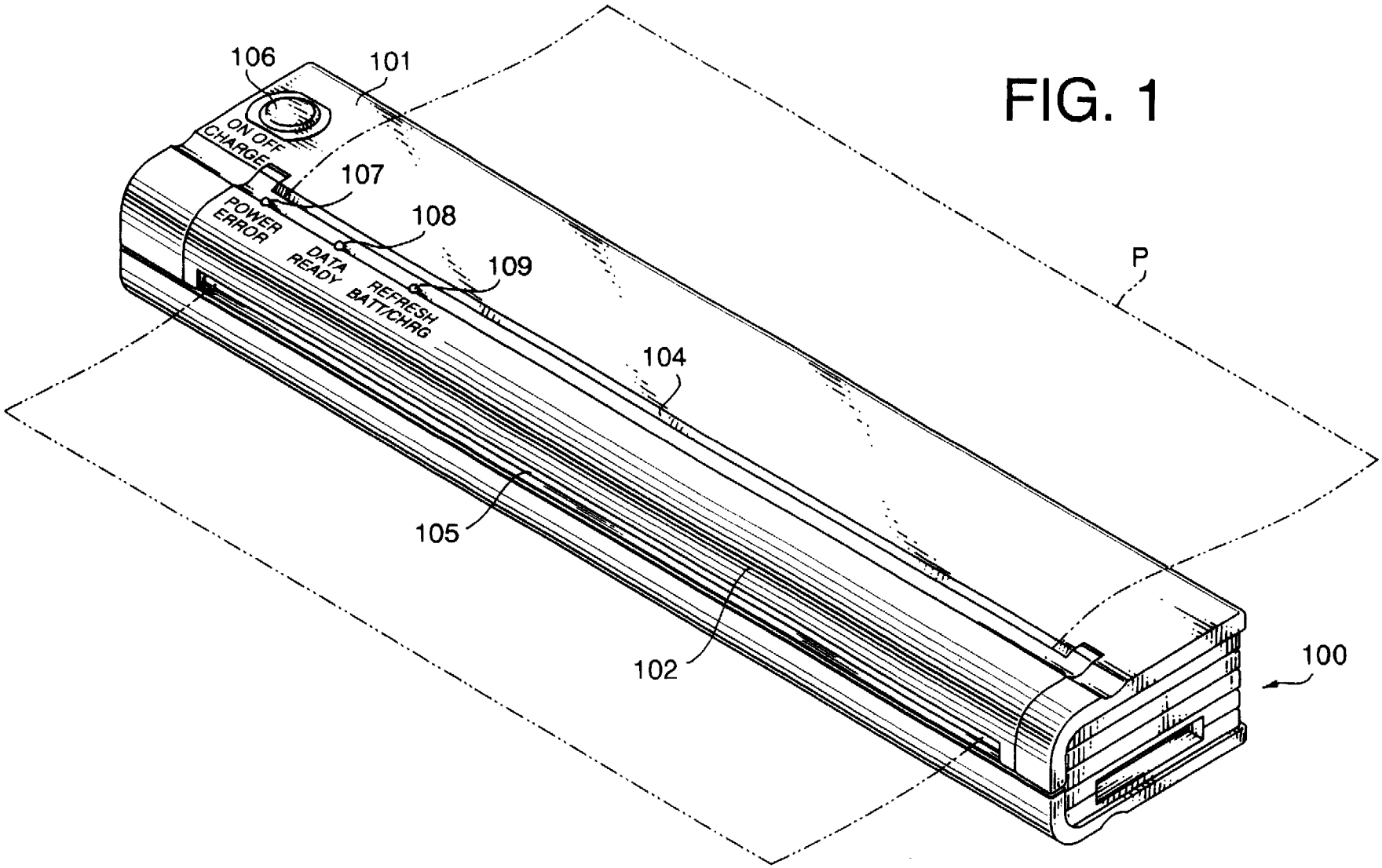
FIG. 1 shows a perspective view of a thermal printer embodying the present invention.

FIG. 1 is a perspective view of a thermal printer 100 embodying the mode control system according to the present invention. The thermal printer 100 has a main housing 101, and a platen roller cover 102. The platen roller cover 102 is hinged, and can be swung such that a platen roller (not shown) is exposed.

Three indicators 107, 108 and 109 are formed on a top surface of the platen roller cover 102. In this embodiment, the three indicators 107, 108 and 109 are LEDs. The indicator 107 indicates whether the power is ON or OFF. The indicator 108 indicates whether data is being received. The indicator 109 indicates information about the operation of a built-in battery (not shown), such as whether the built-in battery is being refreshed (i.e., completely discharged) or charged.

Paper used with the thermal printer 100 is fed into a slot 104 formed between the platen roller cover 102 and the housing 101. An image is formed on the paper using a thermal head 40 (see FIG. 2). The paper then exits the thermal printer 100 through a slot 105, formed between the platen roller cover 102 and the housing 101.

A mode switch 106 is located on the top surface of the housing 101. The mode switch 106 is a push button switch and is normally open. By pressing the mode switch 106, various modes of operation of the thermal printer 100 can be selected. In the embodiment, the mode switch 106 also turns the power ON and OFF.

Figure 2:
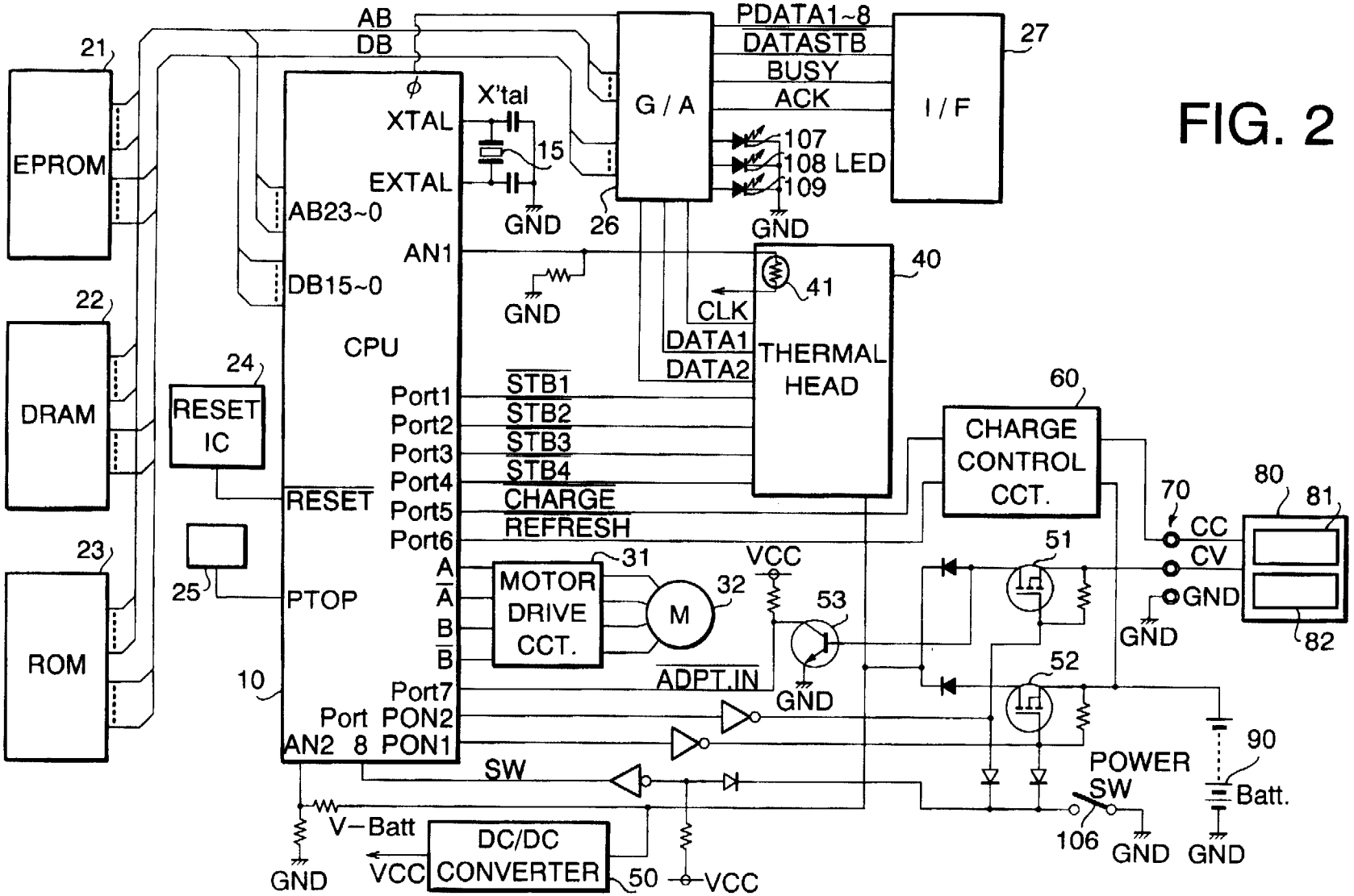
FIG. 2 shows a schematic diagram of the thermal printer shown in FIG. 1.

FIG. 2 is a schematic diagram of the thermal printer 100 shown in FIG. 1.

A CPU 10 controls an operation of the thermal printer 100. In the preferred embodiment, the CPU 10 is a microprocessor which can address up to 16 MB (megabytes). The CPU 10 transmits address information from address ports AB0 through AB23, along an address bus AB. The CPU 10 transmits and receives data through data ports DB0 through DB15 and a data bus DB. The CPU 10 is connected to an EPROM 21, a DRAM 22, a font ROM 23, and a gate array 26, via the address bus AB and data bus DB.

The EPROM 21 stores data and software that control the performance, and an initial operation of the thermal printer 100 when the power is turned ON. The DRAM 22 (dynamic RAM) has an area where a converted bit-map of the image is stored, an area for storing data transmitted through an interface 27, and some other work areas. The font ROM 23 stores font data used for converting the image data to the bit-map image that is stored in the DRAM 22.

The CPU 10 uses a gate array 26 to exchange data through the interface 27, and drive the indicators 107, 108 and 109.

The interface 27 is a printer interface (e.g. Centronics interface) which receives print data and control data from a host computer (not shown). The printer interface has eight data lines PDATA 1 through PDATA 8, and three control lines $\overline{\text{DATASTB}}$, BUSY, and ACK. The eight data lines PDATA 1 through PDATA 8 are used to transfer the print data from the host computer. The $\overline{\text{DATASTB}}$ control line initiates the inputting of data to the printer 100 from the host computer. The BUSY control line indicates that the printer 100 cannot accept the print data, while the ACK control line acknowledges reception of the print data. In the specification, a control line, port or signal having a "bar" over its name indicates an active low control line, port or signal, respectively.

A divided voltage V_BATT of the built-in battery (or an external DC voltage) is applied to an analog port AN2 of the CPU 10. The CPU 10 A/D converts the applied analog voltage to a digital value, and detects the voltage of the built-in battery (or external DC source).

A reset IC 24 transmits a reset signal ($\overline{\text{RESET}}$) to a CPU port $\overline{\text{RESET}}$, when the detected voltage level of the battery is lower than a predetermined voltage level. When the $\overline{\text{RESET}}$signal is LOW, the CPU 10 stops operation of the printer 100. Therefore, the printing operation stops when the voltage of the built-in battery (or external DC voltage) is below the predetermined level.

A sensor 25 which is mounted on the platen roller cover 102, detects the presence of the thermosensitive paper in a sheet feed path of the printer 100. If the thermosensitive paper is located in the sheet feed path, the sensor 25 transmits a paper-detect signal to a port PTOP of the CPU 10. By monitoring the port PTOP, the CPU 10 can determine whether the printer 100 has a thermosensitive paper loaded in the sheet feed path, and therefore whether the printer 100 is ready to start the printing operation.

A reference clock signal CLK is generated by the CPU 10 using a crystal 15 and associated hardware, connected to the terminals XTAL and EXTAL of the CPU 10. The reference clock signal CLK is output from a terminal $\phi$ of the CPU 10, to the gate array 26. In accordance with the reference clock signal CLK, the image data is converted to the bit-map image data in the DRAM 22. The data written in the DRAM 22 is transmitted to the gate array 26 and synchronized with the reference clock signal CLK, before being transferred to the thermal print head 40. The data transferred to the thermal head 40 is separated into two separate data blocks: DATA1 and DATA2.

The thermal head 40 has a plurality of thermal elements (not shown). The heat energy generated by each of the thermal elements is controlled by strobe signals $\overline{\text{STB1}}$, $\overline{\text{STB2}}$, $\overline{\text{STB3}}$, $\overline{\text{STB4}}$ (described later), which are transmitted from the ports Port 1 through Port 4 of the CPU 10. Thus, DATA1 and DATA2 identify the thermal elements to be driven, and strobe signals $\overline{\text{STB1}}$ through $\overline{\text{STB4}}$ drive the identified thermal elements to generate the required heat energy for printing the image.

A thermistor 41 is provided on the thermal head 40 for detecting the temperature of the thermal head 40. The output of the thermistor 41 is input to a port AN1 of the CPU 10. The CPU 10 A/D converts the signal input to the port AN1, and detects the temperature of the thermal head 40.

A motor driving signal is transmitted from ports, A, $\overline{A}$, B, $\overline{B}$, for controlling a motor driving circuit 31. The motor driving circuit 31 drives a motor 32. The motor driving circuit 31 will be described in more detail later.

A port PON1 outputs a signal for turning ON or OFF a FET 52. A port PON2 outputs a signal for turning ON or OFF a FET 51. If an external power source (such as an AC adapter) is used to power the printer 100, a transistor 53 is turned ON thereby changing the signal $\overline{\text{ADPT.IN}}$ from High to Low. The CPU 10 monitors the $\overline{\text{ADPT.IN}}$ signal at Port 7, and determines whether the external power supply is connected. If the external power supply is connected (i.e., $\overline{\text{ADPT.IN}}$ is Low), then the CPU 10 drives the FET 51 through port PON2. If the external power supply is not connected (i.e., $\overline{\text{ADPT.IN}}$ is High), then the CPU 10 drives the FET 52 through port PON1.

The CPU 10 detects the status of the switch 106 in accordance with a signal SW transmitted to a Port 8. When the switch 106 is first turned ON, the FET 51 or 52 is turned ON, as described above. Power in supplied from the external power source or the built-in battery to a DC/DC converter 50. The DC/DC converter 50 outputs Vcc which powers, the CPU 10, the EPROM 21, the DRAM 22 and the ROM 23. In this embodiment, Vcc=5 V.

When the FETs 51 and 52 are turned OFF by the signals output from the Ports PON1 and PON2, power is not supplied to the DC/DC converter 50. Therefore, the power to the CPU 10 is cut and the printer 100 is turned OFF. In order to turn the printer 100 ON it is necessary to press the switch 106 again, thereby providing power to the FETS 51 and 52.

The built-in battery 90 is a rechargeable battery, such as a Nickel Cadmium battery. The battery 90 supplies 14.4VDC to the printer 100. A power source connector 70 is provided to connect the external power source, such as an AC adapter 80, to the printer 100. The AC adapter 80 includes a constant current source 81 and a constant voltage source 82. An output of the constant current source 81 is connected to a battery charge control circuit 60, and is used to recharge the battery 90. An output of the constant voltage source 82, is connected to an input of the DC/DC converter 50.

As described above, the constant current source 81 is provided in the AC adapter 80, and not in the printer 100, since the constant current source 81 is only required for charging the battery. Therefore, the size and weight of the printer 100 can be reduced.

In order to maximize the efficiency of charging the battery 90, the battery 90 is first refreshed (completely discharged) before being recharged. This reduces the 'memory' effect of the battery 90. The memory effect of a battery occurs when the battery is recharged without first being fully discharged. That is, if the battery is repeatedly recharged without being fully discharged, the available battery capacity is reduced.

In the embodiment, the refreshing of the battery 90 is controlled by the charging circuit 60. When the battery is to be refreshed, the CPU 10 transmits a $\overline{\text{REFRESH}}$ signal from the Port 6 to the charge control circuit 60. The charge control circuit 60 stops charging the battery 90, the FET 51 is turned OFF, and the FET 52 is turned ON. The FET 52 connects the battery 90 to a load (not shown) in order to refresh the battery 90.

In the embodiment, the charging of the battery 90 is also controlled by the charging circuit 60. When the battery is to be charged, the CPU 10 transmits a $\overline{\text{CHARGE}}$ signal from the Port 5. The charge control circuit 60 starts charging the battery 90 using the constant current source 82 of the AC adapter 80. The voltage of the battery 90 is monitored by the CPU 10, to determine when to stop the charging operation.

The thermal head 40 has 2560 thermal elements arranged along a line, having a length equivalent to a width of one sheet of the thermosensitive paper used in the printer 100. Print data for the first through the 1280th thermal element are grouped as the DATA1, while print data for the 1281st through the 2560th thermal element are grouped as the DATA2. Further, as described above, the data DATA1 and DATA2 are transferred to the thermal head 40 synchronously with the reference clock signal CLK.

The thermal elements are divided into four groups, with each group driven by the strobe signals $\overline{\text{STB1}}$, $\overline{\text{STB2}}$, $\overline{\text{STB3}}$, and $\overline{\text{STB4}}$, respectively.

Figure 3:
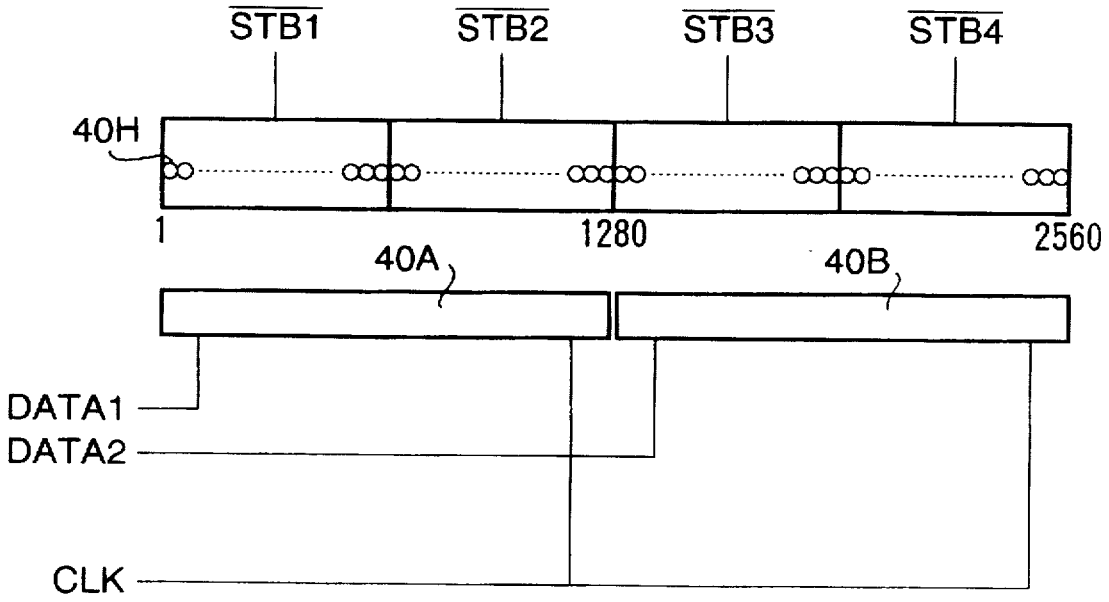
FIG. 3 shows a structure of a thermal head of the thermal printer shown in Fig. 1.

FIG. 3 illustrates a structure of the thermal head 40. The DATA1 used to drive the first through 1280th thermal elements 40H, is sent from the CPU 10 to the shift register 40A, synchronously with the clock signal CLK. Similarly, the DATA2 used to drive the 1281st through 2560th thermal elements 40H, is sent from the CPU 10 to the shift register 40B, synchronously with the clock signal CLK. The data stored in the shift registers 40A and 40B is used to drive the thermal elements 40H. If the data value of a bit stored in the shift register is "1", then the corresponding thermal element 40H is driven (i.e., turned ON) when the strobe signal $\overline{\text{STBn}}$ is LOW.

Figure 4:
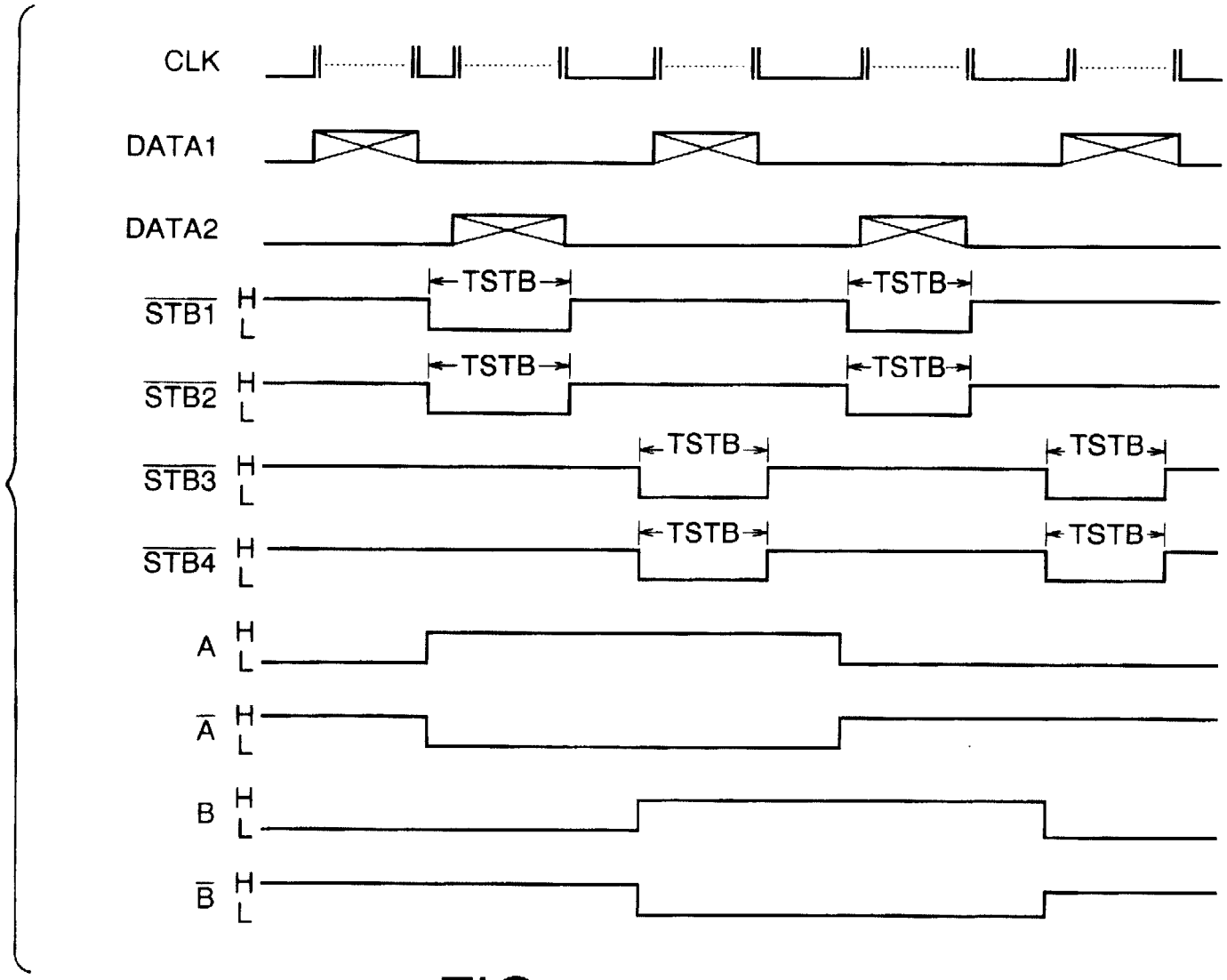
FIG. 4 is a timing diagram of the control of the thermal head and motor.

FIG. 4 is a timing diagram showing the transfer of data to the thermal head 40, the driving of the thermal head 40, and the driving of the motor 32.

After a bit-map image has been formed in the DRAM 22, the data to be printed by the thermal elements 40H (i.e., DATA1 and DATA2) is transmitted from the gate array 26 to the shift registers 40A and 40B.

In the preferred embodiment, a two phase exciting method is used to drive the motor 32. Motor driving pulses A, $\overline{A}$, B, and $\overline{B}$ are sent from the CPU 10 to the motor 32 in one of two states, HIGH or LOW. Initially, the states of the motor driving pulses are as follows: A=LOW, $\overline{A}$=HIGH, B=LOW, and $\overline{B}$=HIGH. Then, when the state of any of the four motor driving pulses A, $\overline{A}$, B, and $\overline{B}$ is changed, the motor 32 feeds the thermal paper half a line. Further, the states of the strobe signals $\overline{\text{STBn}}$ are changed (made LOW) in response to the change in the combination of the four motor driving pulses, in order to transmit the data from the registers 40A, 40B to the thermal elements 40H.

Initially, as shown in FIG. 4, DATA1 which corresponds to the data to drive the first through 1280th thermal elements 40H, is transmitted synchronously with the clock signal CLK, and stored in the shift register 40A. Then when the states of the motor driving pulses A and A are changed, the thermal paper is fed half a line. Simultaneously, the strobe signals $\overline{\text{STB1}}$ and $\overline{\text{STB2}}$ are made LOW for a predetermined time interval TSTB and the first through 1280th thermal elements 40H are driven to form the image on the thermal paper. Further, DATA2 which corresponds to the data to drive the 1281st through 2560th thermal elements 40H, is transmitted synchronously during time interval TSTB, and stored in the shift register 40B.

Then, when the states of motor driving pulses B and $\overline{B}$ are changed, the motor 32 feeds the thermal paper another half line. Simultaneously, the strobe signals $\overline{\text{STB3}}$ and $\overline{\text{STB4}}$ are made LOW for another predetermined time TSTB, and the 1281st through 2560th thermal elements 40H are driven to form the image on the thermal paper. Further, during this time interval TSTB, DATA1 for the next line is transferred to the shift register 40A, and the above process is repeated. The subsequent lines are printed in a similar manner.

Therefore, when the combination of states of the motor driving pulses A, $\overline{A}$, B, or $\overline{B}$ changes, the thermal paper is fed by a half line, and the DATA1 or the DATA2 is transmitted to the shift register 40A or 40B, respectively.

Figure 5:
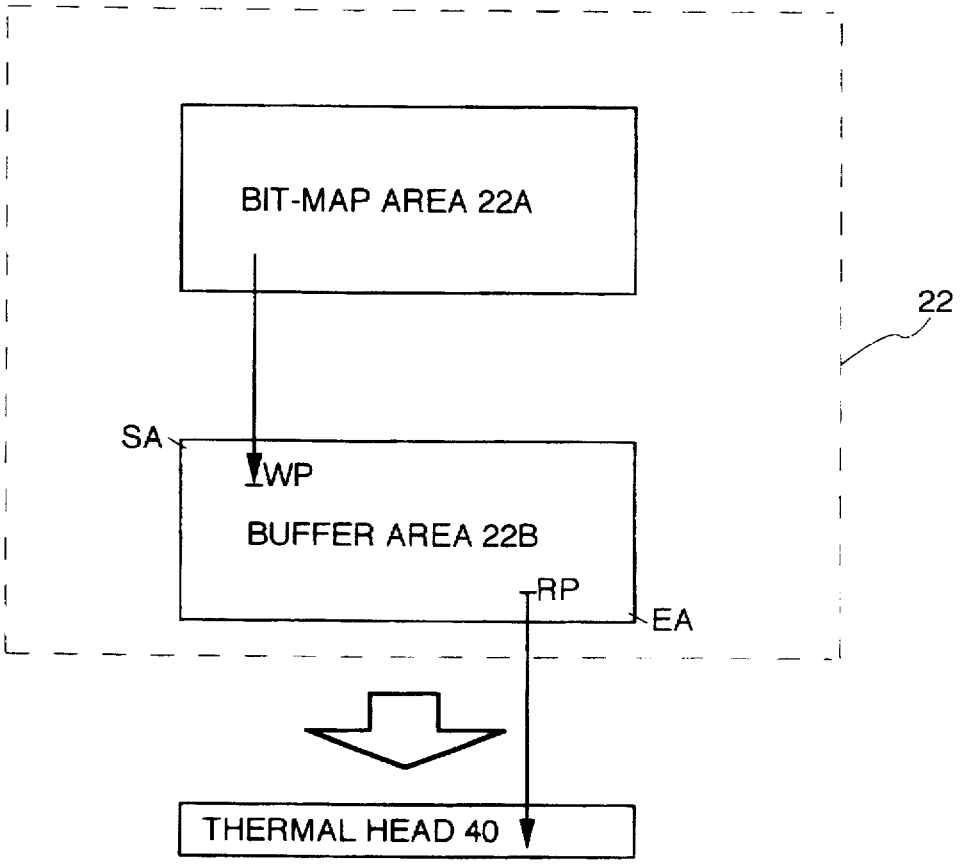
FIG. 5 shows a transfer of data from a bit-map memory to an output buffer memory, and then to a register of the thermal head.

FIG. 5 shows a diagram illustrating the transfer of data from a bit-map area 22A to a buffer area 22B of the DRAM 22 Initially in this embodiment, one page of image data is received from an external device, such as a computer, and stored in a memory. Then, a bit-map of 100 lines of the image to be printed, is developed in the bit-map area 22A. The bit-map image data for the 100 lines is transferred to the buffer area 22B, and then to the shift registers 40A, 40B of the thermal head 40, via the gate array 26. After all the bit-map image data stored in the bit-map memory 22A has been transferred, the bit-map of the subsequent image data (also having 100 lines) is formed in the bit-map memory 22A.

The CPU 10 uses a write pointer WP in order to write data to the buffer area 22B. The write pointer WP is stored in a pointer storage area (not shown) of the DRAM 22. Data output from the bit-map area 22A is stored in the buffer area 22B at the address indicated by the write pointer WP. The write pointer WP is updated after the data has been written to the buffer area 22B.

The CPU 10 also uses a read pointer RP, in order to read data from the buffer area 22B. The read data is then transferred to the register of the thermal head 40. The read pointer RP is then updated after the data has been transferred.

The buffer area 22B is a FIFO (first-in-first-out) controlled memory. Therefore, the data is transferred from the buffer area 22B to the register of the thermal head 40 in the same order in which it was written to the buffer area 22B. Further, bit-map image data can be written to one portion of the buffer area 22B, while bit-map image data is being read from another portion of the buffer area 22B.

Figure 6A:
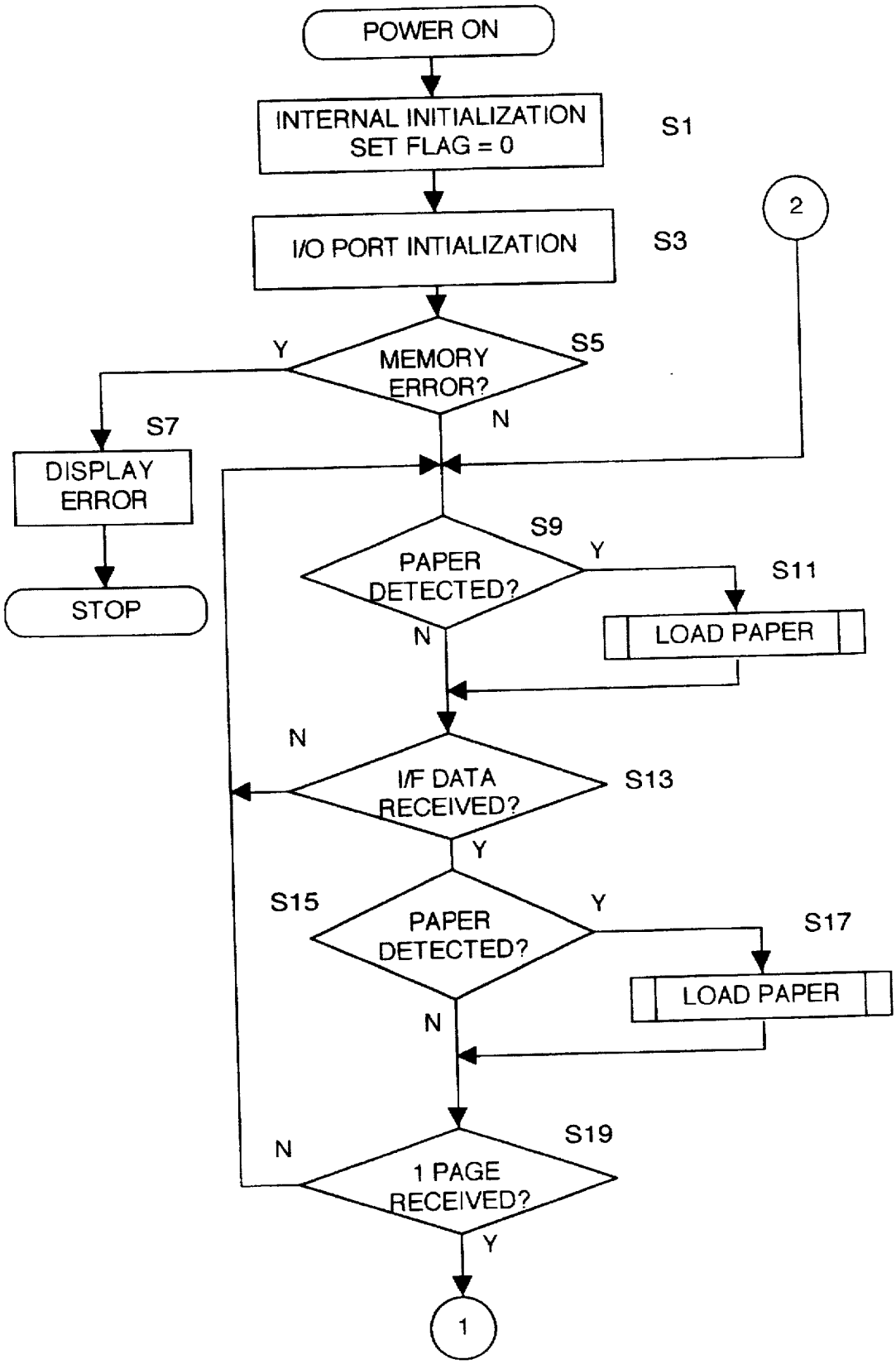
FIGS. 6A and 6B show a flowchart of a printing operation of the thermal printer according to the present invention.
Figure 6B:
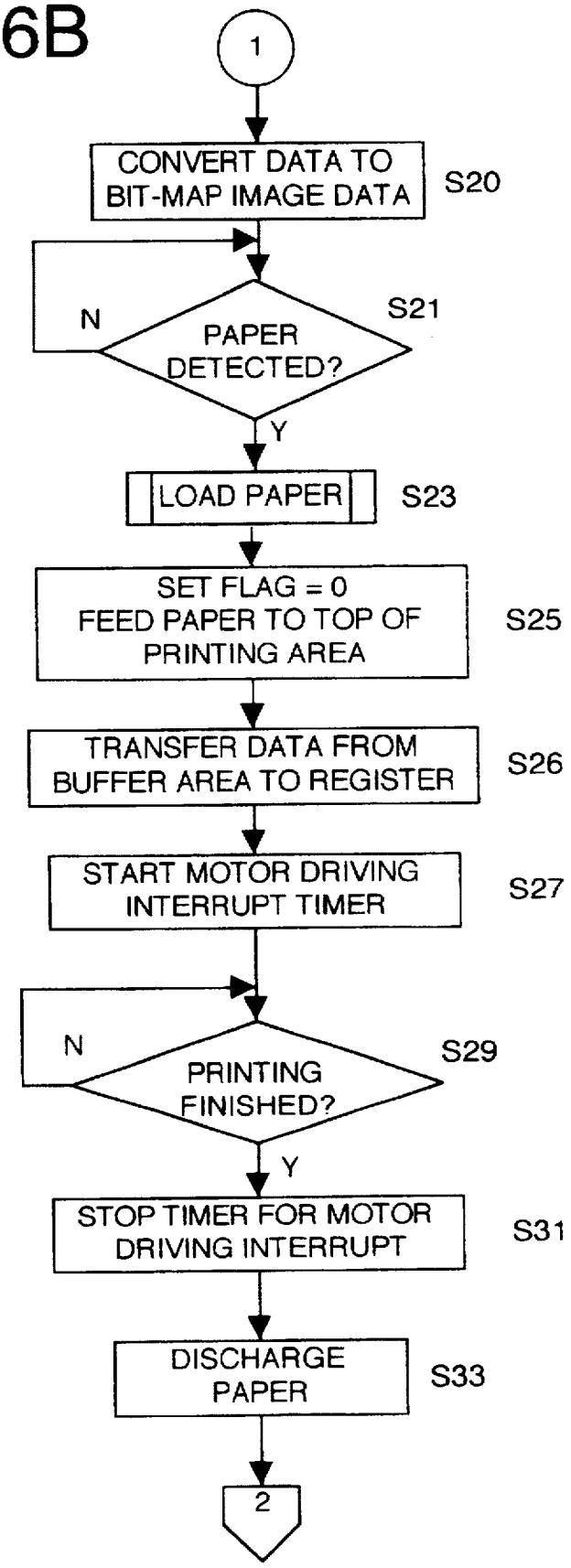

FIGS. 6A and 6B show a flowchart of a main printing operation according to the present invention. In the embodiment, the speed of transferring the data from the buffer area 22B to the registers 40A, 40B of the thermal head 40 is controlled such that the buffer area 22B will not be empty.

After the printer has been turned ON, internal initialization of the thermal printer is performed in step S1. In step S1, a paper feed flag (hereinafter referred to as flag) is set equal to 0. Further, motor driving pulses A, $\overline{A}$, B, and $\overline{B}$ are set to their respective initial values. Then, at step S3 the I/O (input-output) ports, are initialized and step S5 detects whether there is an error in the memory. If there is an error detected (S5:Y), then step S7 displays an error message, and the routine is stopped.

If there is no error detected (S5:N), step S9 is executed. At step S9, the presence of the paper is detected by the sensor 25. If the paper is detected (S9:Y), then the paper is loaded in step S11. The routine of loading the paper is shown in the flowchart of FIG. 7.

Figure 7:
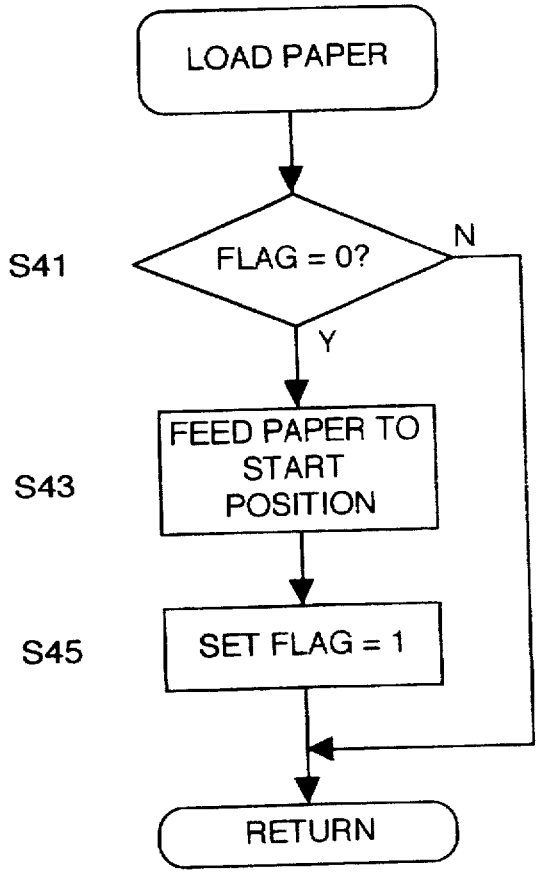
FIG. 7 shows a flowchart of a function called by the printing operation shown in FIGS. 6A and 6B.

As shown in FIG. 7, step S41 determines whether the flag is set equal to 0. If the flag is set equal to 0 (S41:Y), the paper has been detected for the first time, and the paper is fed to a start position, in step S43. Then, step S45, sets the flag equal to 1. If the flag is equal to 1 in step S41, steps S43 and S45 are not executed. The routine then returns to the operation routine shown in FIG. 6A.

After the paper has been fed to the start position in step S11, step S13 detects the presence of data transferred from the interface 27. If no data has been received (S13:N), then control returns to step S9. If data is received (S13:Y), control proceeds to step S15 which detects the presence of the paper. If the paper is detected (S15:Y), the load paper routine described above, is executed in step S17. Control then proceeds to S19. If the paper is not detected in step S15, then step S17 is not executed.

Step S19 determines whether one page of image data has been received. If one page of image data has not been received (S19:N), then control returns to step S9. Otherwise (S19:Y), at step S20, the image data corresponding to 100 lines of bit-map image data is converted to the bit-map image data in the bit-map area 22A, and transferred to the buffer area 22B. Then, step S21 detects the presence of the paper.

If the paper is detected in step S21, then the load paper routine described above, is executed in step S23. If there is no paper detected (S21:N), then control repeats step S21, until the paper is detected.

At step S25, the flag is set to 0. This indicates that the paper has been detected. At step S25, the motor 32 starts to feed the paper to the top of the printing area. At step S26, the DATA1 for the first line of the bit-map image data is transmitted from the buffer area 22B to the register 40A.

Step S27 starts a motor driving interrupt timer, which sets the time that an interrupt procedure used to print the data (described later) can be started. Step S29, determines whether all of the data has been printed. If all of the data has been printed (S29:Y), then step S31 stops the timer for the motor driving interrupt. The thermal paper is then discharged in step 33, and control returns to step S9, where the detection of a subsequent sheet of paper is detected. If all of the data has not been printed (S29:N), then control repeats step S29 until all of the data has been printed.

Figure 8:
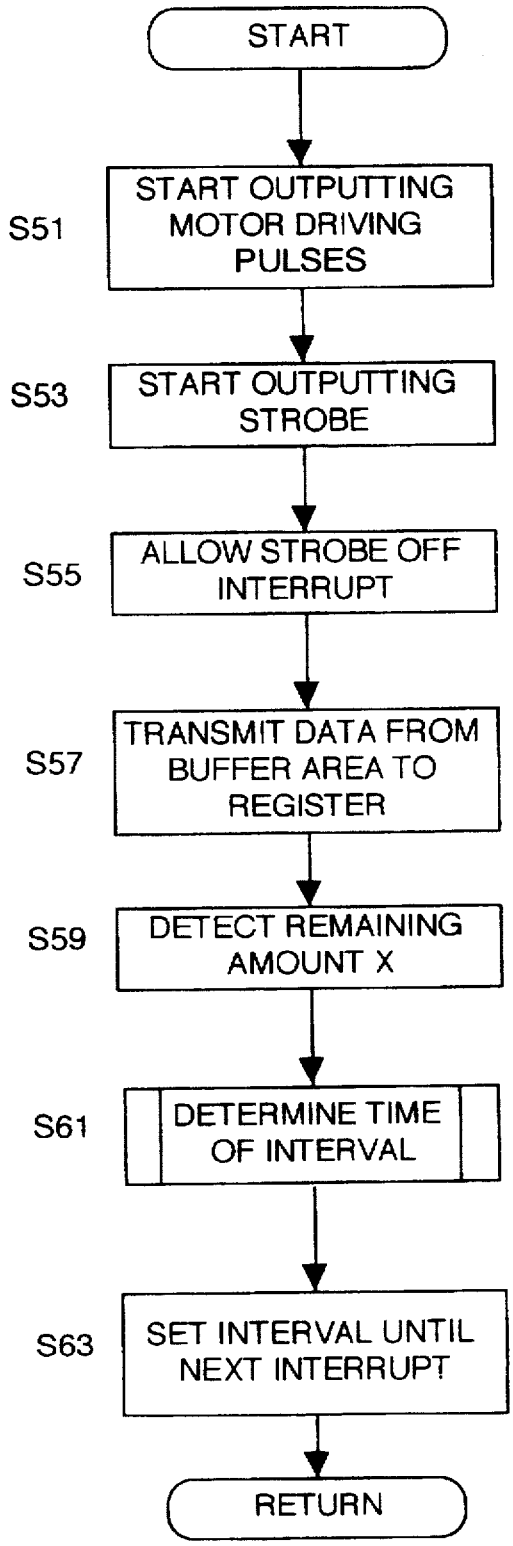
Fig. 8 shows a flowchart of an interrupt procedure used for printing data.

The interrupt procedure for printing the data will be described with reference to FIG. 8.

At step S51, the CPU 10 starts outputting the motor driving pulses A, $\overline{A}$, B, and $\overline{B}$. Then at step S53, the strobe pulses $\overline{STBn}$ are output. As described before, in the case that the DATA1 is stored in the register 40A, the CPU 10 outputs the strobe pulses $\overline{STB1}$ and $\overline{STB2}$. The thermal elements 40H are then driven according to the DATA1, and an image is formed on the thermal paper. Similarly, when the DATA2 is stored in the register 40B, the CPU 10 outputs the strobe pulses $\overline{STB3}$ and $\overline{STB4}$. The thermal elements 40H are then driven according to the DATA2, and an image is formed on the thermal paper.

Step S55 allows a strobe OFF interrupt routine to be executed. Bit-map image data is then transmitted as the DATA1 or DATA2 from the buffer area 22B to one of the registers 40A, 40B, respectively, at step S57. After transmitting the DATA1 or the DATA2 to the register 40A, 40B of the thermal head 40, the CPU 10 determines the remaining amount of data in the buffer area 22B, in step S59.

The remaining amount of data in the buffer area 22B is determined by examining the address of the write pointer WP and the read pointer RP. FIG. 5 shows an example of the locations of the write pointer WP and the read pointer RP in the buffer area 22B, relative to a start address SA and an end address EA (where SA<EA).

If the address $RP_{add}$ of the read pointer RP is less than the address $WP_{add}$ of the write pointer WP, then the remaining amount X of data is given by equation 1 below:

$$X=WP_{add}-RP_{add} \quad (1)$$

However, if the address $RP_{add}$ of the read pointer RP is greater than the address $WP_{add}$ of the write pointer WP, then the remaining amount X of data is given by equation 2 below:

$$X=(WP_{add}-SA)+(EA-RP_{add}) \quad (2)$$

Step S61 determines an interval of time TI until the next printing operation (i.e., interrupt) can occur in accordance with a ratio R of the remaining amount x of data, determined by equations (1) and (2) above, to the total amount of data stored in the buffer area (i.e., EA–SA). The ratio R is given by equation 3 below:

$$R=\frac{X\times 100\%}{EA-SA} \quad (3)$$

The interval of time TI is given by equation (4) below:

$$TI=f(X) \quad (4)$$

where

TI=STI when R≧50%,

TI=STI×K1 when 50%>R≧25%,

TI–STI×K2 when R<25%,

STI is equal to a standard time interval,

K1 is equal to a first constant,

K2 is equal to a second constant, and

1<K1<K2

A routine for determining the interval of time TI will be described below with reference to FIG. 9.

After the interval of time TI has been determined, step S63 sets the interval of time until the next interrupt can be executed in accordance with the time interval TI. Then the interrupt ends.

After the time interval TI has elapsed, the interrupt is executed again. Thus, at step S51, the pattern of the motor driving pulses A, $\overline{A}$, B, and $\overline{B}$ is changed. Therefore, the paper is again fed by half a line, and the strobe pulses $\overline{STBn}$ are output, as described above.

Figure 9:
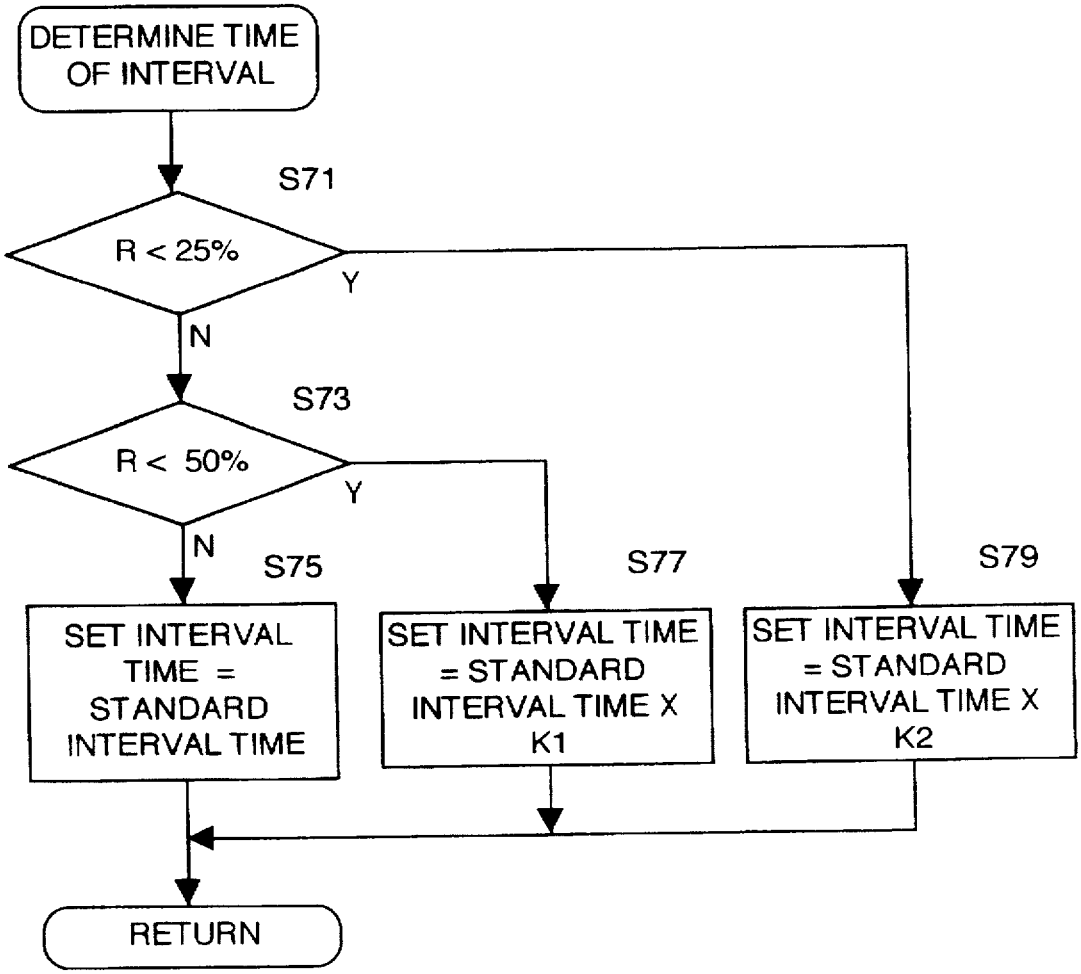
FIG. 9 shows a function called by the interrupt procedure shown in FIG. 8.

FIG. 9 shows an example of a routine used to determine the interval of time TI until the next printing operation can be executed. Step S71 determines whether the ratio R, as determined by equation (3), is less than 25%. If the ratio R is less than 25% (S71:Y), then step S79 sets the time interval TI equal STI×K2. If the ratio R is not less than or equal to 25% (S71:N), then step S73 determines whether the ratio R is less than 50%. If the ratio R is less than 50% (S73:Y), then step S77 sets the time interval TI equal STI×K1. If the ratio R is not less than or equal to 50% (S73:N), then the time interval is set equal to STI. The routine is then ended.

In the embodiment as described above, K1 is greater than 1, and K2 is greater than K1. Therefore, as the amount X of remaining data decreases, the time interval until the next printing operation increases.

Figure 10:
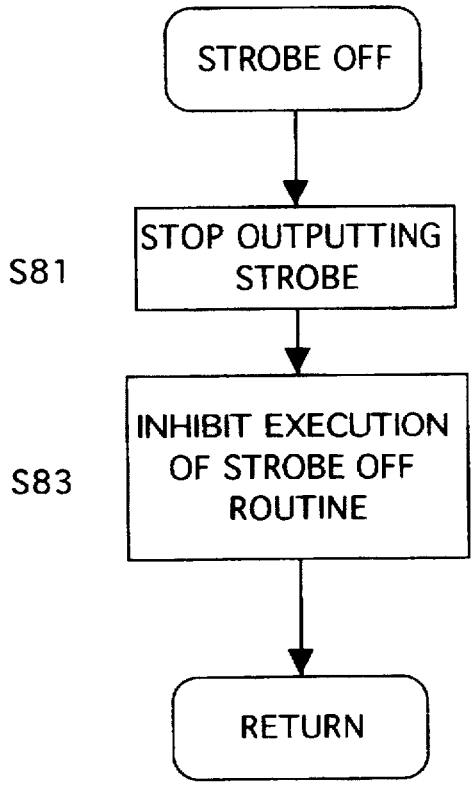
FIG. 10 shows a flowchart of an interrupt procedure used for stopping the printing operation.

FIG. 10 shows a flowchart of an interrupt routine which stops the strobe pulse. In step S81, the output of the strobe pulse is inhibited (i.e., $\overline{STBn}$ is tied HIGH). Then, in step S83, the execution of the strobe OFF routine is set to be inhibited. The execution of the strobe OFF routine will be allowed when step S55 of the routine in FIG. 8 is executed again.

The strobe OFF routine then ends, and control returns to the main program.

As described above, the interval of time between the printing of successive sets of the DATA1 and the DATA2, is varied in accordance with the remaining amount of data in the buffer area 22B. This results in the heating of the thermal head being more uniform since the interval between the driving of the thermal head and the next driving of the thermal head is increased, when the remaining amount of the data decreases. Further, since there is always data in the buffer area 22B during the printing operation, the printing operation is executed continuously.

The present disclosure relates to subject matter contained in Japanese Patent Application No. HEI 6-276,123 filed on Oct. 14, 1994, which is expressly incorporated herein by reference in its entirety.

What is claimed is:

1. A thermal printer for forming an image on a sheet, said thermal printer comprising:

a thermal head having a plurality of linearly arranged thermal elements;

means for converting image information into bit-map image data;

means for storing said bit-map image data;

means for transmitting a predetermined portion of said stored bit-map image data to said thermal head;

means for detecting a remaining amount of said stored bit-map image data which has not been transmitted to said thermal head; and means for setting a time interval between a transmission of said predetermined portion of said stored bit-map image and a subsequent transmission of said predetermined portion of said stored bit-map image data, in response to said detected remaining amount of said stored bit-map image; said setting means increasing said time interval between successive transmissions of said predetermined portion of said bit-map image data as the amount of remaining data decreases.

2. The thermal printer according to claim 1, wherein said sheet is a thermosensitive sheet.

3. The thermal printer according to claim 1, said thermal head comprising a register for temporarily storing said bit-map image data, said plurality of linearly arranged thermal elements being energized in accordance with said bit-map image data stored in said registers.

4. The thermal printer according to claim 3, further comprising:

means for feeding said sheet; and means for energizing said plurality of thermal elements in accordance with said predetermined portion of said bit-map image data, said bit-map image data being transmitted synchronously with a feeding of said sheet, wherein a feeding speed of said sheet is controlled in response to said time interval set by said setting means.

5. The thermal printer according to claim 4, further comprising means for generating a pulse, a width of said pulse being determined in accordance with said time interval set by said setting means, wherein said feeding means comprises a pulse motor, said thermal elements being energized synchronously with a change in a phase of said pulse.

6. The thermal printer according to claim 1, wherein said setting means increases said time interval between successive transmissions of said predetermined portion of said bit-map image data as the amount of remaining data decreases.

7. The thermal printer according to claim 6, wherein said setting means sets said time interval such that said time interval changes stepwisely with respect to a continuous change in said remaining amount.

8. The thermal printer according to claim 6, said setting means setting said time interval to a first value, if said remaining amount of said data is greater than 50% of said total data stored in said storing means, said setting means setting said time interval to a second value, if said remaining amount of said data is not greater than 50% but greater than 25% of said total data stored in said storing means, and said setting means setting said time interval to a third value, if said remaining amount of said data is not greater than 25% of said total data stored in said storing means, wherein said second value is greater than said first value, and said third value is greater than said second value.

9. The thermal printer according to claim 1, said converting means comprising another means for storing said bit-map image data, said thermal printer further comprising another transmitting means for transmitting said bit-map image data stored in said another storing means, to said storing means, wherein said setting means sets said time interval such that a transmission speed of said transmitting means does not exceed a transmission speed of said another transmitting means.

10. The thermal printer according to claim 1, wherein said predetermined portion corresponds to a line of said image data.

11. A method of driving a thermal line printer for forming an image on a sheet using a thermal line head having a plurality of linearly arranged thermal elements, said method comprising the steps of:

converting image information into a bit-map image data;

storing said bit-map image data;

transmitting a predetermined portion of said stored bit-map image data to said plurality of thermal elements;

detecting a remaining amount of said stored bit-map image data which has not been transmitted to said plurality of thermal elements; and setting a time interval between a transmission of said predetermined amount of said stored bit-map image data and a subsequent transmission of said predetermined amount of said stored bit-map image data, in accordance with said detected remaining amount of said stored bit-map image data, the setting of the time interval increases the time interval between successive transmissions of the predetermined portion of the bit-map image data as the amount of remaining data decreases.

12. A thermal printer for forming an image on a page of a sheet, said thermal printer comprising:

a thermal head having a plurality of linearly arranged thermal elements;

a bit-map memory for storing bit-map image data that is to be printed by said thermal printer;

a buffer memory for receiving said bit-map image data from said bit-map memory, said bit-map image data being transmitted from said buffer memory to said thermal head;

a first transmitting means for transmitting said bit-map image data from said bit-map memory to said buffer memory;

a second transmitting means for transmitting said bit-map image data from said buffer memory to said thermal head, line by line; and a controller for controlling a transmission of said bit-map image data by said second transmitting means so that said buffer memory always stores data to be printed while said image is being printed on said page of said sheet;

wherein said bit-map image data stored in said bit-map memory corresponds to a predetermined portion of said image to be printed on a page.

13. The thermal printer according to claim 12, wherein a subsequent bit-map image is developed in said bit-map memory after all of said bit-map image data stored in said bit-map memory has been transmitted to said buffer memory.

14. The thermal printer according to claim 12, wherein said buffer memory is a FIFO controlled memory.

15. The thermal printer according to claim 12, wherein said thermal head comprises a register having a plurality of bits corresponding to said thermal elements, each bit of said register indicating whether the corresponding thermal element is to be energized.

16. A thermal printer for forming an image on a sheet, said thermal printer comprising:

a thermal head having a plurality of linearly arranged thermal elements;

means for converting image information into bit-map image data;

first memory for storing said bit-map image data;

second memory for storing a predetermined portion of said bit-map image data;

means for transmitting said predetermined portion of said bit-map image data from said first memory to said second memory;

means for detecting a remaining amount of said bit-map image data stored in said first memory which has not been transmitted to said second memory; and means for setting a time interval between a transmission of said predetermined portion of said bit-map image data and a subsequent transmission of said predetermined portion of said bit-map image data, in response to said detected remaining amount of said bit-map image data stored in said first memory.

* * * * *

UNITED STATES PATENT AND TRADEMARK OFFICE

CERTIFICATE OF CORRECTION

PATENT NO. : 5,777,657

DATED : July 7, 1998

INVENTOR(S) : Kiyoshi Negishi, et al.

It is certified that error appears in the above-identified patent and that said Letters Patent is hereby corrected as shown below:

Cancel claim 6.

Column 10, line 62, change "6" to --1--.

Column 10, line 66, change "6" to --1--.

Signed and Sealed this

Seventh Day of December, 1999

*Attest:*

*Attesting Officer*

Q. TODD DICKINSON

*Acting Commissioner of Patents and Trademarks*